US011454409B2

(12) United States Patent
Li et al.

(10) Patent No.: US 11,454,409 B2
(45) Date of Patent: Sep. 27, 2022

(54) FAILURE DETECTION METHOD FOR AIR CONDITIONING SYSTEM

(71) Applicant: Carrier Corporation, Palm Beach Gardens, FL (US)

(72) Inventors: Sheng Li, Shanghai (CN); Xinyu Wu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 373 days.

(21) Appl. No.: 16/816,876

(22) Filed: Mar. 12, 2020

(65) Prior Publication Data

US 2020/0292191 A1 Sep. 17, 2020

(30) Foreign Application Priority Data

Mar. 15, 2019 (CN) ..... 201910198178.4

(51) Int. Cl.
*F24F 11/30* (2018.01)
*F24F 140/60* (2018.01)
*F24F 140/10* (2018.01)

(52) U.S. Cl.
CPC ..... *F24F 11/30* (2018.01); *F24F 2140/10* (2018.01); *F24F 2140/60* (2018.01)

(58) Field of Classification Search
CPC .... F24F 11/30; F24F 2140/10; F24F 2140/60; F24F 11/38; F24F 11/61; F24F 11/64;
(Continued)

(56) References Cited

U.S. PATENT DOCUMENTS 4,338,791 A * 7/1982 Stamp, Jr. ..... G05D 23/1917 165/242
5,440,891 A * 8/1995 Hindmon, Jr. ..... F25B 49/022 236/78 D (Continued)

FOREIGN PATENT DOCUMENTS

CN 1170097 A 1/1998
CN 1313786 A 9/2001

(Continued)

*Primary Examiner* — Ramesh B Patel
(74) *Attorney, Agent, or Firm* — Cantor Colburn LLP

(57) ABSTRACT

A fault detection method for an air conditioning system is provided by the present disclosure. The air conditioning system has a liquid pump and an injector. The fault detection method includes: automatically learning to obtain a monotonically decreasing fault detection characteristic curve Y=K(X−XMAX)+A by using an electrical power consumption of the liquid pump and a high-pressure-side pressure of the injector; wherein when Y and A are 0, X corresponds to a maximum high-pressure-side pressure Xmax of the injector; and when the current pressure of the injector Xcurrent≤Xmax: if the current electrical power consumption Ycurrent<K(Xcurrent−Xmax)+A, then a probability of the injector state of the air conditioning system being normal is greater than a first preset value; and if the current electrical power consumption Ycurrent>K(Xcurrent−Xmax)+A, a probability of the injector of the air conditioning system having a fault is greater than a second preset value.

10 Claims, 1 Drawing Sheet

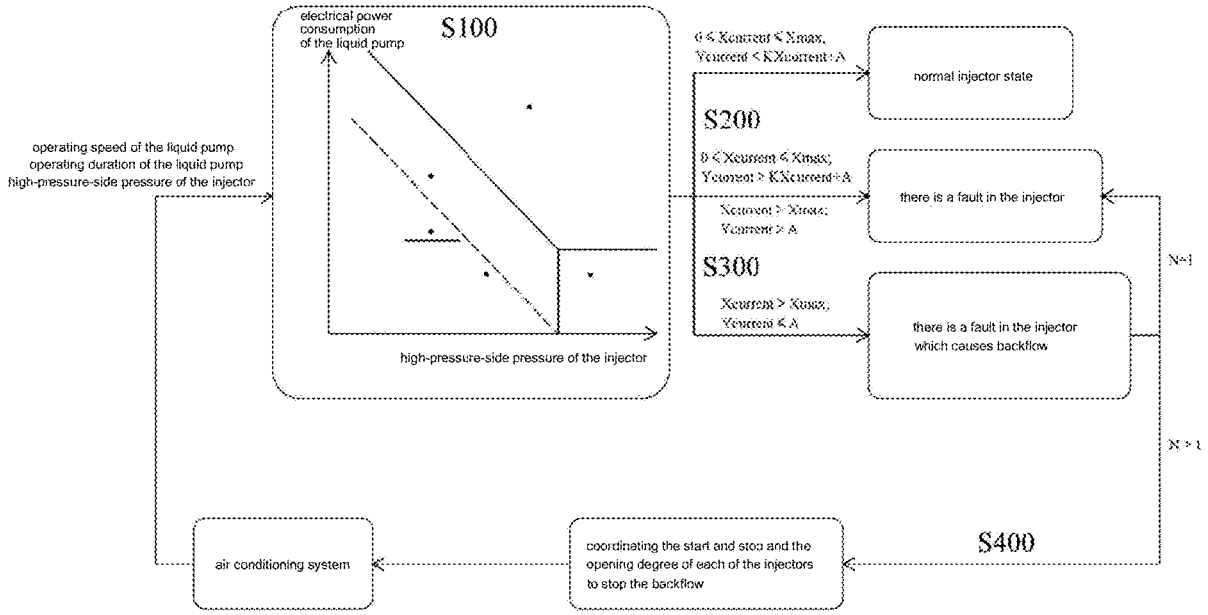

(58) Field of Classification Search
CPC ..... F24F 2140/12; F24F 2140/20; F25B 1/06; F25B 49/005; F25B 49/02
See application file for complete search history.

(56) References Cited

U.S. PATENT DOCUMENTS

| | | | | |
|---|---|---|---|---|
| 5,642,278 | A * | 6/1997 | Wang | G01N 30/32 700/282 |
| 6,460,354 | B2 | 10/2002 | Yabuki et al. | |
| 7,079,967 | B2 | 7/2006 | Rossi | |
| 7,117,081 | B2 | 10/2006 | Sawaoka | |
| 7,444,251 | B2 * | 10/2008 | Nikovski | F24F 11/30 702/108 |
| 7,987,679 | B2 * | 8/2011 | Tanaka | F25B 13/00 62/126 |
| 10,592,821 | B2 * | 3/2020 | Denton | F24F 11/62 |
| 10,678,416 | B2 * | 6/2020 | Fadell | G05D 23/1902 |
| 10,739,027 | B2 * | 8/2020 | Abiprojo | G06Q 10/06 |
| 11,306,927 | B2 * | 4/2022 | Dempster | F24F 11/83 |
| 11,326,805 | B2 * | 5/2022 | Li | F25B 49/022 |
| 2008/0033674 | A1 * | 2/2008 | Nikovski | F24F 11/30 702/108 |
| 2012/0210736 | A1 * | 8/2012 | Rockenfeller | F25B 49/02 62/115 |
| 2015/0300714 | A1 * | 10/2015 | Ishimura | F25B 41/20 62/228.1 |
| 2016/0109147 | A1 * | 4/2016 | Uno | F24F 11/62 700/276 |
| 2016/0252266 | A1 * | 9/2016 | Ushirosako | G05B 15/02 700/278 |
| 2017/0343227 | A1 * | 11/2017 | Mowris | F24F 11/30 |
| 2018/0119997 | A1 | 5/2018 | Siegert et al. | |
| 2019/0258237 | A1 * | 8/2019 | Buda | G05B 23/0243 |
| 2019/0309970 | A1 * | 10/2019 | Park | G06N 3/04 |
| 2020/0292191 | A1 * | 9/2020 | Li | F24F 11/30 |
| 2020/0292200 | A1 * | 9/2020 | Li | F25B 9/08 |
| 2021/0041121 | A1 * | 2/2021 | Park | F24F 11/56 |
| 2021/0123622 | A1 * | 4/2021 | Notaro | F24F 11/62 |

FOREIGN PATENT DOCUMENTS

| | | | |
|---|---|---|---|
| CN | 1172137 | C | 10/2004 |
| CN | 1906453 | A | 1/2007 |
| CN | 1989377 | A | 6/2007 |
| CN | 101319826 | A | 12/2008 |
| CN | 100549574 | C | 10/2009 |
| CN | 101952670 | A | 1/2011 |
| CN | 103003645 | A | 3/2013 |
| CN | 103403463 | A | 11/2013 |
| CN | 104204697 | A | 12/2014 |
| CN | 103003643 | B | 12/2015 |
| CN | 106662367 | A | 5/2017 |
| CN | 108562064 | A | 9/2018 |
| JP | 4151680 | B2 | 9/2008 |
| JP | 2008261590 | A | 10/2008 |
| JP | 4905406 | B2 | 3/2012 |
| JP | 5494280 | B2 | 5/2014 |
| WO | 2018159322 | A1 | 9/2018 |

* cited by examiner

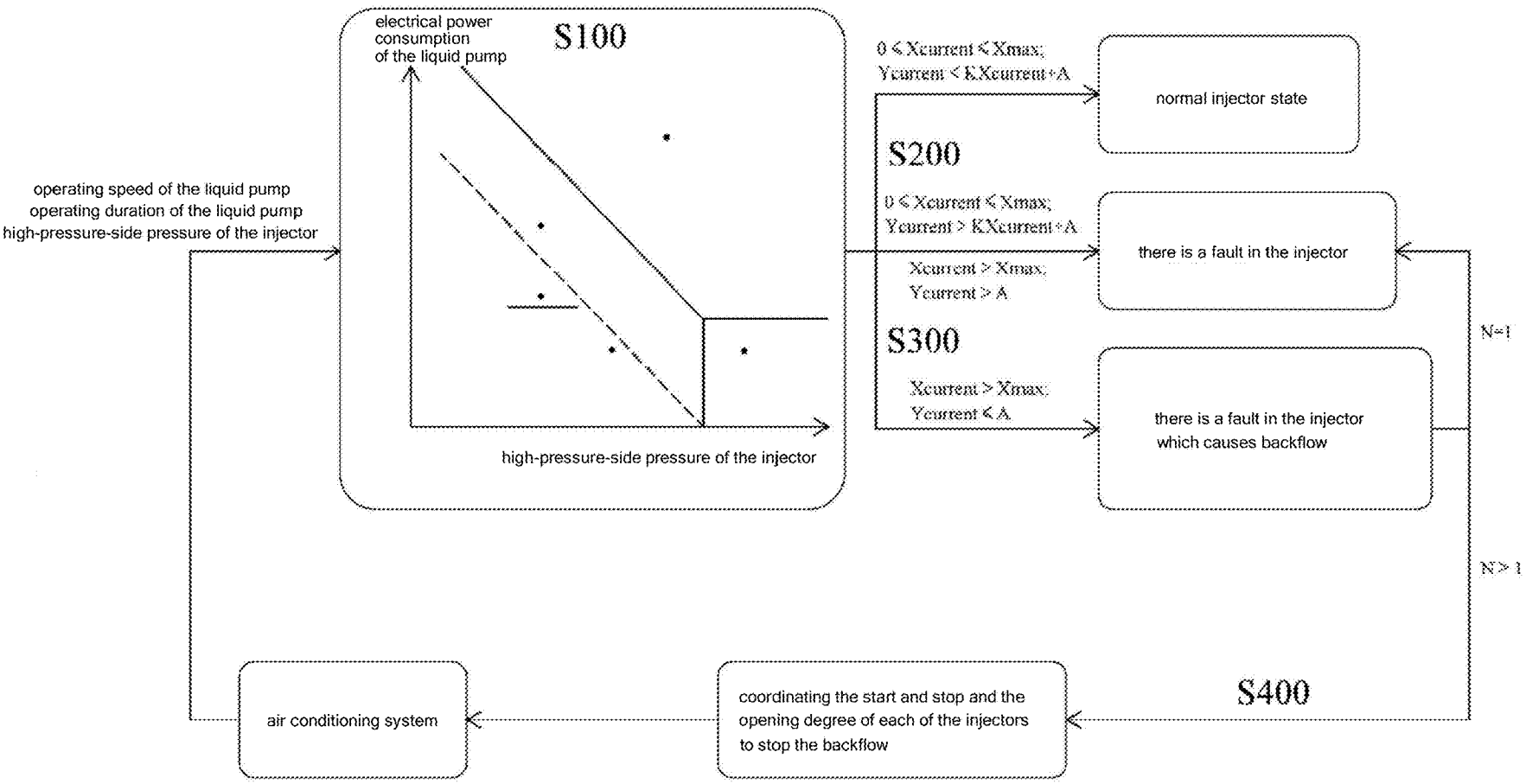
operating speed of the liquid pump
operating duration of the liquid pump
high-pressure-side pressure of the injector
S100
electrical power consumption of the liquid pump
high-pressure-side pressure of the injector
0 ≤ Xcurrent < Xmax;
Ycurrent < KXcurrent+A
S200
normal injector state
0 ≤ Xcurrent < Xmax;
Ycurrent > KXcurrent+A
there is a fault in the injector
Xcurrent > Xmax;
Ycurrent > A
S300
there is a fault in the injector which causes backflow
Xcurrent > Xmax;
Ycurrent < A
N=1
N>1
S400
coordinating the start and stop and the opening degree of each of the injectors to stop the backflow
air conditioning system

FAILURE DETECTION METHOD FOR AIR CONDITIONING SYSTEM

FOREIGN PRIORITY

This application claims priority to Chinese Patent Application No. 201910198178.4 filed Mar. 15, 2019, and all the benefits accruing therefrom under 35 U.S.C. § 119, the contents of which in its entirety are herein incorporated by reference.

FIELD OF THE INVENTION

The present disclosure relates to the field of heat exchange, and in particular to an air conditioning system and a fault detection method therefor.

BACKGROUND OF THE INVENTION

At present, large-scale refrigeration systems in commercial applications, especially those with large differential pressure requirements, can be equipped with injectors to increase system efficiency. Moreover, such large-scale commercial refrigeration systems often use multiple sets of parallel injectors to achieve better partial load regulation capability and operating efficiency under partial load conditions. For example, under partial load conditions, when only part of the indoor heat exchange units are activated according to actual needs, the refrigeration system does not need to maintain full load operation, and only part of the injectors are required to operate to achieve the highest efficiency. However, it is also necessary to properly coordinate the number of injectors required to be opened and the relationship of their opening degrees in order to achieve stable on-demand cooling and improved energy efficiency. However, in this process, it is highly possible that a backflow problem occurs at the injector due to the fault of the injector itself or the fault of the controller's control of the injector, which in turn greatly affects the reliability of the system operation and system efficiency. Therefore, how to determine the cause of the backflow problem according to the parameters under partial load conditions characterized by the system when the backflow problem occurs, and then make corresponding adjustments and treatments has become a technical problem to be solved urgently.

SUMMARY OF THE INVENTION

In view of this, an air conditioning system and a fault detection method therefor are provided by the present disclosure, thereby effectively solving or at least alleviating one or more of the above problems in the prior art and problems in other aspects.

In order to achieve at least one object of the present disclosure, a fault detection method for an air conditioning system is provided according to an aspect of the present disclosure, wherein the air conditioning system has an injector and a liquid pump for providing pressure compensation; and the fault detection method includes: S100, automatically learning to obtain a monotonically decreasing fault detection characteristic curve $Y=K(X-XMAX)+A$ by using an electrical power consumption of the liquid pump and a high-pressure-side pressure of the injector; where Y is the electrical power consumption of the liquid pump, X is the high-pressure-side pressure of the injector, K is a slope of the fault detection characteristic curve obtained by automatic learning, and A is a set fault tolerance value, which is not less than 0; and wherein when Y and A are 0, X corresponds to a maximum high-pressure-side pressure Xmax of the injector; and S200, when the current pressure of the injector $Xcurrent \leq Xmax$: if the current electrical power consumption $Ycurrent < K(Xcurrent-Xmax)+A$, then a probability of the injector state of the air conditioning system being normal is greater than a first preset value; and if the current electrical power consumption $Ycurrent > K(Xcurrent-Xmax)+A$, a probability of the injector of the air conditioning system having a fault is greater than a second preset value.

Optionally, S300 is further included: when $Xcurrent > Xmax$: if $Ycurrent > A$, the probability of the injector of the air conditioning system having a fault is greater than the second preset value; if $Ycurrent \leq A$, and the number of injector is $N=1$, the probability of the injector of the air conditioning system having a fault is greater than the second preset value; and if $Ycurrent \leq A$, and the number of injectors is $N>1$, a probability of backflow of the injectors of the air conditioning system caused by a control fault is greater than a third preset value.

Optionally, S300 is further included: when $Xcurrent > Xmax$, if $Ycurrent > K(Xcurrent-Xmax)+A$, the probability of the injector of the air conditioning system having a fault is greater than the second preset value; if $Ycurrent \leq K(Xcurrent-Xmax)+A$, and the number of injector $N=1$, the probability of the injector of the air conditioning system having a fault is greater than the second preset value; and if $Ycurrent \leq K(Xcurrent-Xmax)+A$, and the number of injectors is $N>1$, a probability of backflow of the air conditioning system caused by a control fault is greater than a third preset value.

Optionally, if backflow of the air conditioning system is caused by a control fault, the method further includes S400: coordinating the start and stop and the opening degree of each of the injectors to stop the backflow.

Optionally, the set fault tolerance value A corresponds to a fault detection sensitivity of the air conditioning system, and when A increases from 0, the corresponding fault detection sensitivity gradually decreases.

Optionally, the set fault tolerance value A is 10% of a rated electrical power consumption of the liquid pump.

Optionally, the maximum high-pressure-side pressure Xmax of the injector is associated with a condensing pressure of the refrigerant of the air conditioning system under a steady-state working condition at a highest outdoor temperature in the summer or at a system-designed outdoor temperature in the summer.

Optionally, the maximum high-pressure-side pressure Xmax of the injector is associated with the number of injectors and the high-pressure-side temperature.

Optionally, the maximum high-pressure-side pressure Xmax of the injector is associated with a thermal performance of the injector and a set value of compensation pressure of the liquid pump.

Optionally, the current electrical power consumption of the liquid pump in the air conditioning system is obtained by calculation using an operating speed of the liquid pump, an operating duration, and corresponding pressures on both sides of the liquid pump during operation; or by querying an electric meter; or by calculation using current and voltage measurements of the liquid pump.

Optionally, the method of automatically learning to obtain the fault detection characteristic curve described in S100 includes one or more of function fitting, constructing an artificial neural network, and constructing a support vector machine model.

Optionally, the electrical power consumption of the liquid pump and the high-pressure-side pressure of the injector as selected for obtaining the fault detection characteristic curve are analog values during the operation of the air conditioning system.

Optionally, the electrical power consumption of the liquid pump and the high-pressure-side pressure of the injector as selected for obtaining the fault detection characteristic curve are historical data recorded during the steady-state operation of the air conditioning system.

In order to achieve at least one object of the present disclosure, according to another aspect of the present disclosure, an air conditioning system is further provided, which includes: a liquid pump for providing pressure compensation; an injector; and a controller for performing the control method as described above.

Optionally, the air conditioning system includes a cooling system, a heat pump system or a refrigeration/freezing system.

According to the air conditioning system of the present disclosure and the fault detection method therefor, the monotonically decreasing fault detection characteristic curve Y=K(X−XMAX)+A is established by automatically learning the electrical power consumption of the liquid pump and the high-pressure-side pressure of the injector, and the current electrical power consumption of the liquid pump is compared with the characteristic curve to evaluate whether the system has a backflow and whether the cause of the backflow is the injector fault. The entire fault detection process can be performed based on the existing sensors in existing systems and parameters acquired by them, the determination is accurate, and the cost will not rise since there is no need to increase additional hardware.

BRIEF DESCRIPTION OF THE DRAWINGS

The technical solutions of the present disclosure will be further described in detail below with reference to the accompanying drawings and embodiments, but it should be understood that the drawings are only provided for the purpose of explanation, and should not be considered as limiting the scope of the present disclosure. In addition, unless otherwise specified, the drawings are only intended to conceptually illustrate the structures and constructions described herein, and are not necessarily drawn to scale.

FIG. 1 is a schematic control diagram of an air conditioning system of the present disclosure.

DETAILED DESCRIPTION OF THE EMBODIMENT(S) OF THE INVENTION

The present disclosure will be described in detail below with reference to the exemplary embodiment in FIG. 1. However, it should be understood that the present disclosure may be embodied in a variety of different forms and should not be construed as being limited to the embodiments set forth herein. The embodiments are provided to make the disclosure of the present disclosure more complete and thorough, and to fully convey the concept of the present disclosure to those skilled in the art.

It should also be understood by those skilled in the art that the air conditioning system proposed by the present disclosure does not narrowly refer to an air conditioner in the industry which is used in a building and equipped with an outdoor cooling/heating unit and an indoor heat exchange unit. Rather, it should be considered as a kind of thermodynamic system with air conditioning function, which is driven by various types of power sources (for example, electric power) to exchange heat with the air at a position to be adjusted, by means of a phase change of the refrigerant in the system. For example, when the air conditioning system is used in a Heating Ventilating & Air Conditioning (HVAC) system in a building, it may be a refrigeration system with a cooling-only function (only cooling) or a heat pump system with both cooling and heating functions. As another example, when the air conditioning system is used in the field of cold chain, it may be a transport refrigeration system or a refrigeration/freezing system. However, in view of the basis of fault detection of the present concept, an injector and a liquid pump should be present in any of the foregoing air conditioning systems so as to be suitable for the method of the present concept.

Specifically, a fault detection method for an air conditioning system is provided herein. As described above, the air conditioning system to which the fault detection method is applied should at least have an injector and a liquid pump for providing pressure compensation in the heat exchange circuit thereof. The control method includes at least the following steps.

First, S100 is executed, in which a monotonically decreasing fault detection characteristic curve Y=K(X−XMAX)+A is obtained through automatically learning by using an electrical power consumption of the liquid pump and a high-pressure-side pressure of the injector; where Y is the electrical power consumption of the liquid pump, X is the high-pressure-side pressure of the injector, K is a slope of the fault detection characteristic curve obtained by automatic learning, and A is a set fault tolerance value, which is not less than 0; wherein when Y and A are 0, X corresponds to a maximum high-pressure-side pressure Xmax of the injector. This step is intended to provide a fault detection characteristic curve as a basis for particular fault determination, i.e., a fault detection function.

The theoretical basis for constructing this function is that the injector in the air conditioning system is primarily configured to create a pressure differential for the refrigerant, whereas the liquid pump is configured to provide pressure compensation when the pressure of the refrigerant injected through the injector is insufficient. The greater the pressure on the high-pressure side of the injector is, the shorter the time required to open the liquid pump will be, and the lower the rotational speed will be; even when the pressure on the high-pressure side of the injector is sufficiently large, the liquid pump need not be activated. The activation duration and the rotational speed of the liquid pump are parameters reflecting the electrical power consumption of the liquid pump, so the electrical power consumption of the liquid pump decreases as the pressure on the high-pressure side of the injector increases. Therefore, the function has a monotonically decreasing characteristic.

Then, S200 is executed, in which when the current pressure of the injector Xcurrent≤Xmax: if the current electrical power consumption Ycurrent<K(Xcurrent−Xmax)+A, then a probability of the injector state of the air conditioning system being normal is greater than a first preset value; and if the current electrical power consumption Ycurrent>K(Xcurrent−Xmax)+A, a probability of the injector of the air conditioning system having a fault is greater than a second preset value. This step is intended to provide a way to specifically apply this characteristic curve to determine a fault. Based on the theoretical basis of the foregoing function construction, if the current high-pressure-side pressure Xcurrent of the injector is higher, then its current electrical power consumption Ycurrent of the liquid pump should be less than the value K (Xcurrent−Xmax)+A brought by the characteristic curve; when it is larger than this value, it indicates that the liquid pump consumes too much electrical power at this point, and there is an abnormal situation, which is highly likely caused by an injector fault. The reason for introducing the determination probability is that the air conditioning system is not always in a steady state operation. In a transient operation under some working conditions which change rapidly, it is still possible for a sudden change in electrical power consumption to occur due to various reasons. Such a situation may also lead to mis-determination. Therefore, the introduction of the determination probability can make the determination result more reliable. The setting of the first preset value or the second preset value may be adjusted according to the system sensitivity desired by the user. For example, if the user wants the system to have higher sensitivity so that it can report errors for various situations that may cause problems, then the second preset value may be increased; and if the user wants the system to have a higher degree of fault tolerance and only report errors for serious situations, the second preset value may be decreased. Similarly, if the user wants the system to have higher sensitivity so that it can report errors for various situations that may cause problems, then the first preset value may be decreased; and if the user wants the system to have a higher degree of fault tolerance and only report errors for serious situations, the first preset value may be increased.

According to the embodiment of the above fault detection method, the monotonically decreasing fault detection characteristic curve Y=K(X-Xmax)+A is established by automatically learning the electrical power consumption of the liquid pump and the high-pressure-side pressure of the injector, and the current electrical power consumption of the liquid pump is compared with the characteristic curve to evaluate whether the system has a backflow and whether the cause of the backflow is the injector fault. The entire fault detection process can be performed based on the existing sensors in existing systems and parameters acquired by them, the determination is accurate, and the cost will not rise since there is no need to increase additional hardware.

With regard to the above fault detection method, it should be known that the injector state being normal and the injector having a fault are not limited to the injector hardware being normal or having a fault; rather, it is known that relevant factors of the injector are normal, or at least one of the relevant factors has a fault. For example, the controller's control of the injector has a fault; for another example, the injector has an operational problem during certain transient working conditions of system operation. These can all be included in the fault objects described in the fault detection method. Of course, in the actual detection, they may also be screened out during the detection process because of the set tolerance values, rather than being determined as the fault object at the beginning of the determination.

On this basis, in order to further improve the method, the following steps may be added.

For example, the method may further include S300: when Xcurrent>Xmax, if Ycurrent>K(Xcurrent−Xmax)+A, the probability of the injector of the air conditioning system having a fault is greater than the second preset value; if Ycurrent≤K(Xcurrent−Xmax)+A, and the number of injector N=1, the probability of the injector of the air conditioning system having a fault is greater than the second preset value; and if Ycurrent≤K(Xcurrent−Xmax)+A, and the number of injectors is N>1, a probability of backflow of the air conditioning system caused by a control fault is greater than a third preset value. The high-pressure-side pressure of the injector in the steady state operation of the system is usually lower than Xmax, but a situation of the pressure being higher than Xmax may also occur in some transient conditions, this step is intended to provide a supplementary determination mode in a case that the high-pressure-side pressure of the injector is higher than Xmax, in which a further distinction is made. In the first major kind of situations, there still tend to be some problems in the system that cause the injector fault. In the second major kind of situations, it is further determined that there are some problems in the system that cause the injector fault and further causes backflow in the system. At this point, the system backflow has not been attributed to a specific cause, but a further analysis is made thereto. After experiments and researches, it is found that when there is only a single injector operating normally in the system, the possibility of transient backflow due to control fault is low. If the backflow phenomenon still occurs at this point, it is highly possible that the injector has other faults. In this case, the system fault detection method can be terminated here, and further other detections and determinations may be made manually or mechanically. On this basis, the fault detection method may also be further modified to further detect other types of faults. When there are multiple injectors operating normally in the system, the possibility of transient backflow is high. It is highly possible that the backflow phenomenon occurs at this time because of the opening degree coordination problem and control problems between the injectors in the system. Therefore, the cause of the fault can be attributed to the control fault, and subsequent adjustment measures can be made accordingly. Therefore, in the foregoing step S300, a determination of the number of the injectors is additionally introduced to evaluate the cause of the backflow of the system, thereby further improving the accuracy thereof.

In another case, step S300 can be appropriately adjusted as follows: when Xcurrent>Xmax: if Ycurrent>A, the probability of the injector of the air conditioning system having a fault is greater than the second preset value; if Ycurrent≤A, and the number of injector is N=1, the probability of the injector of the air conditioning system having a fault is greater than the second preset value; and if Ycurrent≤A, and the number of injectors is N>1, a probability of backflow of the injectors of the air conditioning system caused by a control fault is greater than a third preset value. This step S300 is substantially similar to the step S300 in the previous embodiment described above, except that the criterion for determining the abnormality of the electrical power consumption of the liquid pump is changed. When Xcurrent>Xmax, if Ycurrent=K(Xcurrent−Xmax)+A is still used as the determination criterion, as the pressure on the high-pressure-side of the injector increases, any fluctuation in the electrical power consumption of the liquid pump may cause fault warning. In this case, a detection delay, sensor noise, and the like may cause a fluctuation of the detected electrical power consumption, thereby triggering an alarm. Therefore, the criterion can be raised herein to determine whether the electrical power consumption of the liquid pump is less than a set fault tolerance value A, thereby appropriately reducing the fault detection sensitivity of the system, avoiding frequent alarming, and thereby improving the stability of system operation.

In another example, the method can further include S400, that is, processing measures required to be performed when it is detected the problem is control fault. In this case, if backflow occurs in the air conditioning system due to a control fault, it is not necessary to replace components of the injector, and the backflow can be stopped by coordinating the start and stop and opening degrees of the respective injectors. The method of stopping the backflow phenomenon by adjusting the injectors already exists in the prior art, and can be directly used to deal with the backflow problem caused by the control fault found in the present disclosure, so it will not be described repeatedly herein.

In addition, regarding the fault detection characteristic curve function established by the present disclosure, several parameters thereof can be acquired in various ways, which will be exemplified as follows.

For example, the set fault tolerance value A thereof corresponds to the fault detection sensitivity of the air conditioning system, and when A increases from 0, the corresponding fault detection sensitivity gradually decreases. It should be understood that the fault tolerance value A described herein can be adjusted by the supplier or the user according to the application scenario or operation requirement of the device. If the system tolerance is good, the fault detection sensitivity can be lowered accordingly, that is, A is increased; and if the system tolerance is poor, the fault detection sensitivity can be raised accordingly, that is, A is reduced. As an example, the set fault tolerance value A is 10% of a rated electrical power consumption of the liquid pump. The fluctuation in the electrical power consumption of the liquid pump caused by a general transient abnormality is usually within this tolerance range.

In another example, the maximum high-pressure-side pressure Xmax of the injector is associated with a condensing pressure of the refrigerant of the air conditioning system under a steady-state working condition at a highest outdoor temperature in the summer or at a system-designed outdoor temperature in the summer Optionally, the maximum high-pressure-side pressure Xmax of the injector is associated with the number of injectors and the high-pressure-side temperature. Optionally, the maximum high-pressure-side pressure Xmax of the injector is associated with a thermal performance of the injector and a set value of compensation pressure of the liquid pump. Specifically, if the thermal performance of the injector is poor (the pressure rise capability is poor), the system will open the liquid pump even under a large high-pressure-side pressure, and Xmax is relatively large; otherwise, Xmax will be relatively small. If a set value of the compensation pressure of the liquid pump is relatively large, the liquid pump may also be opened under a very large high-pressure-side pressure, and Xmax will be very large; otherwise, Xmax will be very small.

In still another example, the current electrical power consumption of the liquid pump in the air conditioning system may be obtained by querying an electric meter. Of course, in a case where it is not desired to additionally add an electric meter and increase the cost, it is also possible to use the existing sensors in the existing systems and calculate the current electrical power consumption of the liquid pump by acquiring an operating speed of the liquid pump, an operating duration, and corresponding high-pressure-side pressure of the injector during operation. Alternatively, the current electrical power consumption of the liquid pump can also be calculated by measuring the current and voltage of the liquid pump.

In addition, it should be understood that the method of automatically learning to obtain the fault detection characteristic curve described in S100 includes one or more of function fitting, constructing an artificial neural network, and constructing a support vector machine model. Moreover, in the process, the multiple values of such parameters as the electrical power consumption of the liquid pump and the high-pressure-side pressure of the injector as selected for obtaining the fault detection characteristic curve are analog values during the operation of the air conditioning system, thereby ensuring that the points selected for constructing the curve are all parameters in the normal state, and there will not be such a situation in which the parameters themselves have problems. Of course, the electrical power consumption of the liquid pump and the high-pressure-side pressure of the injector as selected for obtaining the fault detection characteristic curve may also be historical data recorded during the steady-state operation of the air conditioning system. A technical effect similar to that of the aforementioned analog values can also be achieved by extracting a portion of the steady-state data in the historical data.

In addition, it should be noted that while particular order of steps may have been shown, disclosed, and claimed in the above particular embodiments, it is understood that some steps can be carried out, separated or combined in any order unless it is expressly indicated that they should be executed in the particular order.

Furthermore, an embodiment of an air conditioning system is further provided herein. It can be either a cooling system or a heat pump system, or a refrigeration/freezing system. Moreover, the outdoor cooling/heating unit and the indoor heat exchange unit of the air conditioning system as well as the specific condensing component, evaporating component, throttling components, compressor and the like contained therein may each be conventional mature components, at least including an injector and a liquid pump for providing pressure compensation. Moreover, the controller of the air conditioning system should be capable of being configured to perform the control method according to any of the foregoing embodiments or combinations thereof. In this arrangement, the monotonically decreasing fault detection characteristic curve $Y=K(X-XMAX)+A$ is established by the air conditioning system automatically learning the electrical power consumption of the liquid pump and the high-pressure-side pressure of the injector, and the current electrical power consumption of the liquid pump is compared with the characteristic curve to evaluate whether the system has a backflow and whether the cause of the backflow is the injector fault. The entire fault detection process can be performed based on the existing sensors in existing systems and parameters acquired by them, the determination is accurate, and the cost will not rise since there is no need to increase additional hardware.

The controller described above for performing the aforementioned method may involve several functional entities that do not necessarily have to correspond to physically or logically independent entities. These functional entities may also be implemented in software, or implemented in one or more hardware modules or integrated circuits, or implemented in different processing devices and/or microcontroller devices.

In the description, examples are used to disclose the present disclosure, including the best mode, with the purpose of enabling any person skilled in the art to practice the disclosure, including making and using any device or system and performing any of the methods covered. The scope of protection of the present disclosure is defined by the claims, and may include other examples that can be conceived by those skilled in the art. If such other examples have structural elements that do not differ from the literal language of the claims, or if they include equivalent structural elements that do not substantively differ from the literal language of the claims, these examples are also intended to be included in the scope of the claims.

What is claimed is:

1. A fault detection method for an air conditioning system, wherein the air conditioning system has an injector and a liquid pump for providing pressure compensation; the fault detection method comprising:

S100, learning to obtain a monotonically decreasing fault detection characteristic curve Y=K(X−Xmax)+A by using an electrical power consumption of the liquid pump and a high-pressure-side pressure of the injector; where Y is the electrical power consumption of the liquid pump, X is the high-pressure-side pressure of the injector, K is a slope of the fault detection characteristic curve obtained by learning, A is a set fault tolerance value, which is not less than 0, and Xmax corresponds to a maximum high-pressure-side pressure of the injector; and S200, when the current pressure of the injector Xcurrent≤Xmax: if the current electrical power consumption Ycurrent<K(Xcurrent−Xmax)+A, then a probability of the injector state of the air conditioning system being normal is greater than a first preset value; and if the current electrical power consumption Ycurrent>K(Xcurrent−Xmax)+A, a probability of the injector of the air conditioning system having a fault is greater than a second preset value.

2. The fault detection method according to claim 1, further comprising S300: when Xcurrent>Xmax: if Ycurrent>A, the probability of the injector of the air conditioning system having a fault is greater than the second preset value; if Ycurrent≤A, and the number of injector is N=1, the probability of the injector of the air conditioning system having a fault is greater than the second preset value; and if Ycurrent≤A, and the number of injectors is N>1, a probability of backflow of the injectors of the air conditioning system caused by a control fault is greater than a third preset value.

3. The fault detection method according to claim 1, further comprising S300: when Xcurrent>Xmax, if Ycurrent>K(Xcurrent−Xmax)+A, the probability of the injector of the air conditioning system having a fault is greater than the second preset value; if Ycurrent≤K(Xcurrent−Xmax)+A, and the number of injector N=1, the probability of the injector of the air conditioning system having a fault is greater than the second preset value; and if Ycurrent≤K(Xcurrent−Xmax)+A, and the number of injectors is N>1, a probability of backflow of the air conditioning system caused by a control fault is greater than a third preset value.

4. The fault detection method according to claim 2, wherein if backflow of the air conditioning system is caused by a control fault, the method further comprises S400: coordinating the start and stop and the opening degree of each of the injectors to stop the backflow.

5. The fault detection method according to claim 1, wherein the set fault tolerance value A corresponds to a fault detection sensitivity of the air conditioning system, and when A increases from 0, the corresponding fault detection sensitivity gradually decreases.

6. The fault detection method according to claim 1, wherein the set fault tolerance value A is 10% of a rated electrical power consumption of the liquid pump.

7. The fault detection method according to claim 1, wherein the maximum high-pressure-side pressure Xmax of the injector is associated with a condensing pressure of the refrigerant of the air conditioning system under a steady-state working condition at a highest outdoor temperature in the summer or at a system-designed outdoor temperature in the summer; or the maximum high-pressure-side pressure Xmax of the injector is associated with the number of injectors and the high-pressure-side temperature; or the maximum high-pressure-side pressure Xmax of the injector is associated with a thermal performance of the injector and a set value of compensation pressure of the liquid pump.

8. The fault detection method according to claim 1, wherein the current electrical power consumption of the liquid pump in the air conditioning system is obtained by calculation using an operating speed of the liquid pump, an operating duration, and corresponding pressures on both sides of the liquid pump during operation; or obtained by querying an electric meter; or obtained by calculation using current and voltage measurements of the liquid pump.

9. The fault detection method according to claim 1, wherein the method of learning to obtain the fault detection characteristic curve described in S100 comprises one or more of function fitting, constructing an artificial neural network, or constructing a support vector machine model.

10. The fault detection method according to claim 1, wherein the electrical power consumption of the liquid pump and the high-pressure-side pressure of the injector as selected for obtaining the fault detection characteristic curve are analog values during the operation of the air conditioning system or historical data recorded during the normal steady-state operation of the air conditioning system.

* * * * *